US010383356B2

(12) United States Patent
Matsumura et al.

(10) Patent No.: US 10,383,356 B2
(45) Date of Patent: Aug. 20, 2019

(54) METHOD FOR PRODUCING TOBACCO MOLDED ARTICLE

(71) Applicant: JAPAN TOBACCO INC., Tokyo (JP)

(72) Inventors: Takeshi Matsumura, Tokyo (JP); Tomoichi Watanabe, Tokyo (JP); Masaki Watanabe, Tokyo (JP); Takeshi Akiyama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 138 days.

(21) Appl. No.: 15/707,623

(22) Filed: Sep. 18, 2017

(65) Prior Publication Data

US 2018/0000150 A1 Jan. 4, 2018

Related U.S. Application Data

(63) Continuation of application No. PCT/JP2015/058308, filed on Mar. 19, 2015.

(51) Int. Cl.

| | |
|---|---|
| ***A24B 15/18*** | (2006.01) |
| ***A24B 13/00*** | (2006.01) |
| ***A24B 3/14*** | (2006.01) |
| ***A24B 15/14*** | (2006.01) |
| *A24D 1/00* | (2006.01) |

(52) U.S. Cl.
CPC ..... *A24B 15/18* (2013.01); *A24B 3/14* (2013.01); *A24B 13/00* (2013.01); *A24B 15/14* (2013.01); *A24D 1/002* (2013.01)

(58) Field of Classification Search
CPC combination set(s) only.
See application file for complete search history.

(56) References Cited

U.S. PATENT DOCUMENTS

| | | | | |
|---|---|---|---|---|
| 3,894,544 | A * | 7/1975 | Egri | A24B 3/14 131/370 |
| 4,632,131 | A | 12/1986 | Burnett et al. | |
| 4,972,855 | A * | 11/1990 | Kuriyama | A24B 15/14 131/111 |
| 2007/0240726 | A1 | 10/2007 | Sendo et al. | |
| 2011/0139164 | A1 | 6/2011 | Mua et al. | |
| 2011/0220130 | A1 | 9/2011 | Mua et al. | |
| 2013/0160779 | A1 | 6/2013 | Chida et al. | |

(Continued)

FOREIGN PATENT DOCUMENTS

| | | | |
|---|---|---|---|
| EP | 0339658 | A2 | 11/1989 |
| JP | 4-320673 | A | 11/1992 |

(Continued)

OTHER PUBLICATIONS

Extended European Search Report for European Application No. 15885493.5, dated Oct. 23, 2018.

(Continued)

*Primary Examiner* — Eric Yaary
(74) *Attorney, Agent, or Firm* — Birch, Stewart, Kolasch & Birch, LLP

(57) ABSTRACT

According to one embodiment, a method of producing a tobacco molded article, includes formulating a tobacco kneaded material by kneading a tobacco mixture containing a tobacco raw material, a binder and water, molding the tobacco kneaded material to obtain a molded body and adding a flavor to the molded body.

10 Claims, 4 Drawing Sheets

(56) References Cited

U.S. PATENT DOCUMENTS

| | | | | |
|---|---|---|---|---|
| 2013/0269715 | A1* | 10/2013 | Rushforth ..... | A24B 15/14<br>131/111 |
| 2014/0261504 | A1 | 9/2014 | Griscik et al. | |
| 2017/0143029 | A1 | 5/2017 | Griscik et al. | |

FOREIGN PATENT DOCUMENTS

| | | | |
|---|---|---|---|
| JP | 6-9497 | B2 | 2/1994 |
| JP | 2013-513399 | A | 4/2013 |
| WO | WO 2006/064704 | A1 | 6/2006 |
| WO | WO 2011/139730 | A1 | 11/2011 |

OTHER PUBLICATIONS

International Search Report issued in PCT/JP2015/058308 (PCT/ISA/210), dated Jun. 16, 2015.
Written Opinion of the International Searching Authority issued in PCT/JP2015/058308 (PCT/ISA/210), dated Jun. 16, 2015.

* cited by examiner

METHOD FOR PRODUCING TOBACCO MOLDED ARTICLE

CROSS-REFERENCE TO RELATED APPLICATIONS

This application is a Continuation Application of PCT Application No. PCT/JP2015/058308, filed Mar. 19, 2015, the entire contents of which are incorporated herein by reference.

BACKGROUND OF THE INVENTION

1. Field of the Invention

The present invention relates to a method for producing a tobacco molded article.

2. Description of the Related Art

Conventionally, flavor suction devices for smoking tobacco molded articles comprising tobacco particles as a tobacco raw material, are known.

A flavor suction device includes a tobacco molded article and a holder such as a smoke pipe, and the tobacco molded article is mounted to the holder for smoking. Specifically, the user mounts a tobacco molded article to the holder and then lights the tobacco molded article. The user can inhale flavor components released from the tobacco molded article through the holder while smoldering after lit. Such tobacco molded articles are produced by a variety of methods.

For example, JP 1884489 B discloses that a raw material containing a tobacco powder, a binder and a flavor is molded into a desired shape to be air permeable by, for example, a punched press method.

However, with the technique of JP 1884489 B, when the raw material is molded by an extrusion molding machine and also when it is differentiated into the respective brands by the flavors added to the raw material, it is required to change the mixture ratio from the step of preparing the raw material for producing some other product brand. Thus, the changing of the product brand influences substantially all of the production steps. In other words, a great deal of and complicated change in process is required each time the product brand is changed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The present invention provides a method of producing a tobacco molded article, which can simplify the operations when changing the brand.

According to an aspect of the present invention, there is provided a method of producing a tobacco molded article, comprising: formulating a tobacco kneaded material by kneading a tobacco mixture containing a tobacco raw material, a binder and water; molding the tobacco kneaded material to obtain a molded body; and adding a flavor to the molded body.

A method of producing a tobacco molded article according to an embodiment will now be described with reference to the drawings.

Figure 1:
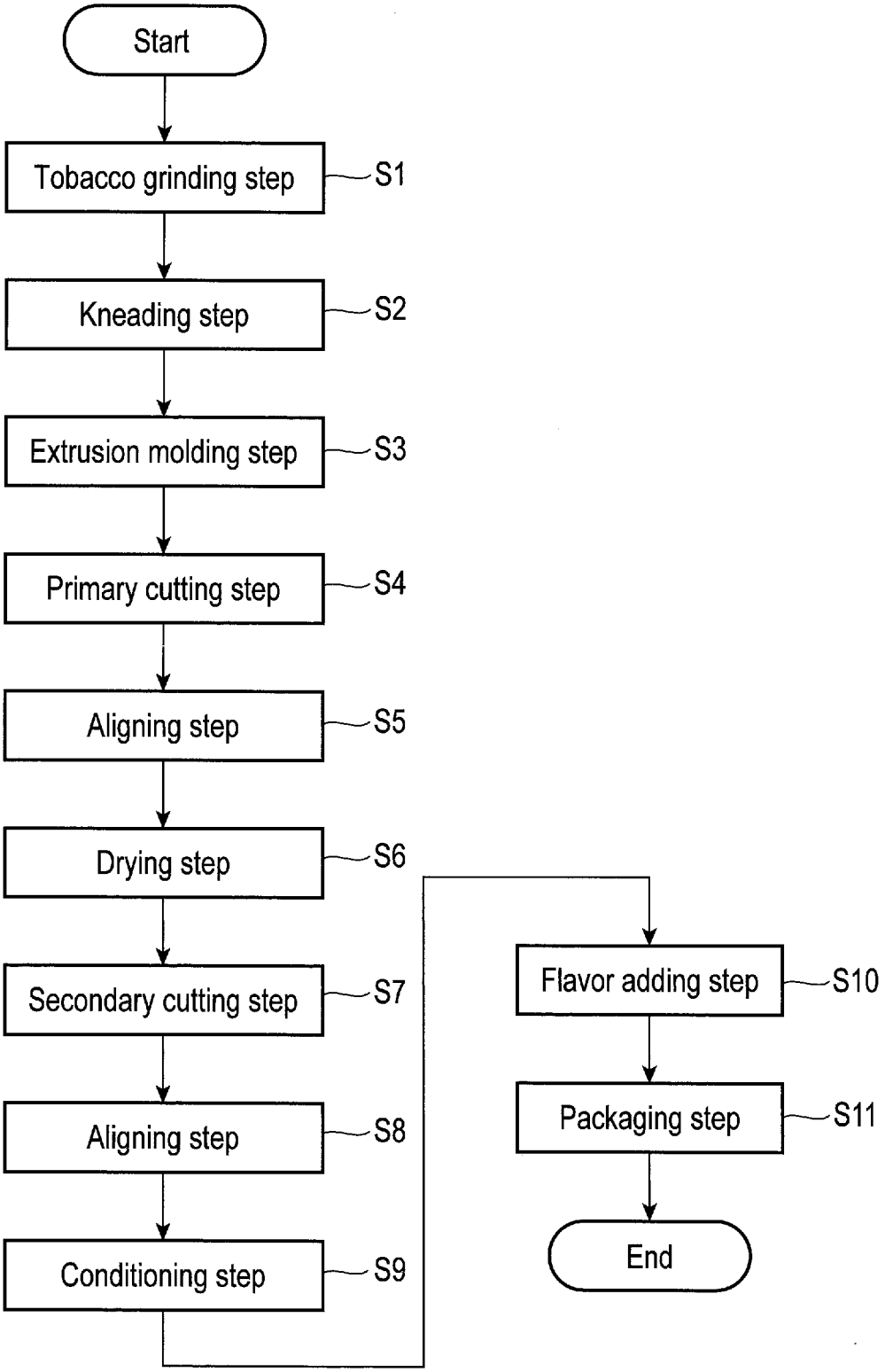
FIG. 1 is a flowchart showing a producing process of a tobacco molded article according to an embodiment.

FIG. 1 is a flowchart showing a producing process of a tobacco molded article according to the embodiment.

(Tobacco Grinding Step)

In a tobacco grinding step S1, a tobacco raw material is ground into a powder form.

The tobacco raw material may be any one of conventionally kinds known as general tobacco products, for example, Oriental, Virginia and Burley. The tobacco raw material may be selected from one or more of these kinds. The ground tobacco raw materials can be classified into a plurality of groups according to the size of the particles, to be used.

(Kneading Step)

In a kneading step S2, a tobacco mixture containing the ground tobacco raw material, a binder and water is kneaded by, for example, a kneader to prepare a kneaded material.

The tobacco mixture contains a flavor component originated from the tobacco raw material.

The tobacco raw material should preferably be contained in the tobacco mixture in a range of 30% by weight to 60% by weight. When the blending amount of the tobacco raw material to less than 30% by weight, the blending ratio of the tobacco raw material contained in the tobacco molded article may become excessively low after a drying step, which will be described later. As a result, when the obtained tobacco molded article is smoldering (when smoking), the amount of flavor components released is reduced, and therefore the taste (smoke flavor) created by the flavor components may be deteriorated. On the other hand, when the amount of the tobacco raw material exceeds 60% by weight, the amount of other additives (for example, the amount of the binder) may become excessively small. As a result, the moldability in the extrusion molding step, which will be described later cannot be ensured, or the apparent density of the tobacco molded article thus obtained cannot be sufficiently suppressed (insufficient porosity), making it difficult to impart sufficient ignition property and sustainability of smoldering to the tobacco molded article.

The binder is used to bind tobacco raw material pieces. Examples of the binder include carboxymethylcellulose (CMC), a salt thereof, alginic acid, pectin, carrageenan and guar gum. Of these, preferable binders are carboxymethylcellulose or its salts such as sodium carboxymethylcellulose.

The amount of binder blended in the tobacco mixture should preferably be 5% by weight or less. If the amount of the binder exceeds 5% by weight, when the obtained tobacco molded article is smoldering (when smoking), the excessive amount of binder may undesirably deteriorate taste (smoke flavor) created by the flavor components of the tobacco raw material with components released from the binder.

Further, the amount of the tobacco raw material in the tobacco mixture is relatively decreased, taste (smoke flavor) created by the flavor components may be degraded. A more preferable amount of the binder in the tobacco mixture is 2% by weight or more and 5% by weight or less. The amount of water in the tobacco mixture should preferably be 20 to 40% by weight. In this embodiment, the unit "% by weight" is defined as a % by weight on the dry basis "%, D.B.".

The tobacco mixture should more preferably contain polyol. Polyol can ensure the moldability in the extrusion molding step, which will be described later and further can make the molded body porous in a drying step, thereby making it possible to improve the ignition property and sustainability of smoldering of the tobacco molded article thus obtained. Examples of polyol include ethylene glycol, propylene glycol and tetramethylene glycol. Of these, the particularly preferable polyol is propylene glycol.

The amount of polyol blended in the tobacco mixture should preferably be 10% by weight or more and 30% by weight or less. If the amount of polyol is less than 10% by weight, or exceeds 30% by weight, it is difficult to ensure the moldability in the extrusion molding step, which will be described later, or sufficiently suppress the apparent density of the tobacco molded article thus obtained (insufficient porosity). As a result, it becomes difficult to improve the ignition property and sustainability of smoldering of the tobacco molded article. A more preferable amount of polyol in the tobacco mixture is 12% by weight or more and 22% by weight or less.

The tobacco mixture is allowed to further contain an alkali metal salt or alkaline-earth metal salt. In order to obtain a tobacco molded article having a honeycomb structure, which will be described later, an alkali metal salt or alkaline-earth metal salt can enhance the strength of its outer wall and partition walls. Further, it is possible to improve also the sustainability of smoldering of the tobacco molded article. Examples of the alkali metal salt include sodium carbonate and potassium carbonate. For example, as an alkaline-earth metal salt, calcium carbonate is preferable.

The amount of the alkali metal salt or alkaline-earth metal salt blended in the tobacco mixture should preferably be 10% by weight or more and 30% by weight or less. When the amount of the alkali metal salt or alkaline-earth metal salt is less than 10% by weight, it is difficult to sufficiently exhibit the effect of enhancing the strength of the outer wall and the partition walls and also the effect of improving the sustainability of smoldering of the tobacco molded article in the case of obtaining a tobacco molded article having a honeycomb structure, which will be described later. When the amount of the alkali metal salt or alkaline-earth metal salt exceeds 30% by weight, the amount of the tobacco raw material is relatively decreased. As a result, the amount of flavor components released during the smoldering (smoking) of the tobacco molded article is decreased, thereby taste (smoke flavor) created by the flavor components may be degraded.

(Molding Step)

The tobacco kneaded material is loaded into a barrel of the extruder in a molding step (for example, extrusion molding step) S3. The extruder feeds the loaded tobacco kneaded material by the screw in the barrel to a die, and continuously extrudes the molded body from the die. The continuous molded body (rod-shaped molded body) has a rod-like shape extending along, for example, the axial direction. The molded body should preferably be formed into a honeycomb shape comprising an outer circumferential wall, partition walls, and a plurality of ventilation passages and a plurality of grooves extending along the axial direction, similar to those of the tobacco molded article as a final product, which will be described later. Here, the honeycomb-shaped molded body may be cylindrical column along the axial direction, or polygonal column such as a quadratic prism or hexagonal column.

The rod-shaped molded body extruded from the extruder is received by a transfer device such as a conveyor, and conveyed in a direction away from the extruder along the transfer device.

(Primary Cutting Step—Aligning Step)

The rod-shaped molded body is conveyed by the transfer device and sent to a primary cutting step S4. In the primary cutting step S4, the rod-shaped molded body while being conveyed along the transfer device is cut into pieces of a predetermined length using, for example, a vibrated wire. Such wire cutting is able to desirably cut a soft molded body immediately after extrusion, which is in a low shape retention state in the maintenance of the outer shape. As a result, it is possible to prevent deformation or crushing of the cut surface of the molded body, and therefore prevent, in, for example, a molded body having a honeycomb structure, the blockage of ventilation passages caused by the crushing in the cut surface. Thus, a tobacco molded article can be obtained with ventilation passages for air to smoothly flow into the inside. Further, the cutting of the rod-shaped molded body makes it possible to carry out the following processing steps in a batch manner. In this embodiment, the predetermined length is that which is suitable to be loaded into a drying equipment. Prior to the wire cutting, the rod-shaped molded body may be subjected to pre-drying such as drying by winding.

The molded bodies cut by the cutting apparatus are aligned in an aligning step S5. More specifically, first trays each comprising a plurality of grooves (for example, V-shaped grooves) are prepared. Then, the molded bodies cut into a length suitable for the drying equipment are horizontally arranged respectively in the grooves of each first tray.

(Drying Step)

In a drying step S6, these first trays each accommodating the molded bodies aligned therein are loaded on, for example, a plurality of multi-stage shelves of the drying equipment, to dry the molded bodies by heating.

Here, the drying should preferably be carried out at a constant temperature. The temperature of the constant temperature drying should be 40° C. or higher and less than 100° C., or particularly preferably, 70° C. or higher and 90° C. or less. The drying time, when the drying temperature is 75° C., should preferably 16 hours or more and 20 hours or less.

The moisture in the molded bodies is volatilized by drying, the moisture content of the molded bodies is reduced to, for example, a value greater than 0% by weight and 5% by weight or less. Further, when polyol is contained in the tobacco mixture, the polyol in the molded bodies is also volatilized by the drying to be decreased to a predetermined value, and then the molded bodies can be made porous.

(Secondary Cutting Step)

The dried molded bodies are unloaded from the first trays and transferred to a secondary cutting step S7. In the secondary cutting step S7, the dried molded bodies are cut with, for example, a blade with abrasive grains into a length of the final product.

(Aligning Step—Conditioning Step)

The molded bodies cut out into the final product length are transferred to an aligning step S8, where they are loaded onto conditioning trays. In a conditioning step S9, the conditioning trays on which the molded bodies of the final product length are loaded are placed in a conditioning chamber of a thermo-hygrostat device, to be subjected to the conditioning process to control the taste (smoke flavor) by the flavor components.

The conditioning chamber to condition the molded bodies of the final product length should preferably be maintained at a temperature of 21° C. or higher and 23° C. or lower, and at a humidity of 57% or higher and 63% or lower. The moisture content of the molded bodies of the final product length after being conditioned under these conditions should preferably be, for example, 5% by weight or higher and 15% by weight or less, and more preferably, 7% by weight or higher and 15% by weight or less.

(Flavor Adding Step—Packaging Step)

In order to differentiate the brand of tobacco molded articles, the conditioned molded bodies of the final product length are transferred to a flavor adding step S10. The flavor adding step S10 should preferably comprise, for example, a step of inclining the conditioned molded bodies of the final product length to have ventilation passages formed therethrough at least along the axial direction, with respect to the direction of gravity, and a step of adding a flavor to the upper surfaces while the ventilation passages of the molded bodied being inclined.

A more preferable flavor adding step S10 comprises a step of preparing a second tray comprising a plurality of bottomed cylindrical portions and projections each provided in a bottom of each respective bottomed cylindrical portion and having a width less than that of the bottomed cylindrical portions, a step of inserting the molded bodies formed into the final product length to have ventilation passages formed therethrough at least along the axial direction, to the bottomed cylindrical portions with the cut surfaces thereof being positioned upward and downward respectively and the lower cut surface of each molded body being partially in contact with the respective projection, thereby storing the molded bodies of the final product length respectively in the bottomed cylindrical portions while the ventilation passages thereof being inclined with respect to the direction of gravity, and a step of spraying a flavor on the upper surface of each molded body stored in each bottomed cylinder portion.

Figure 2:
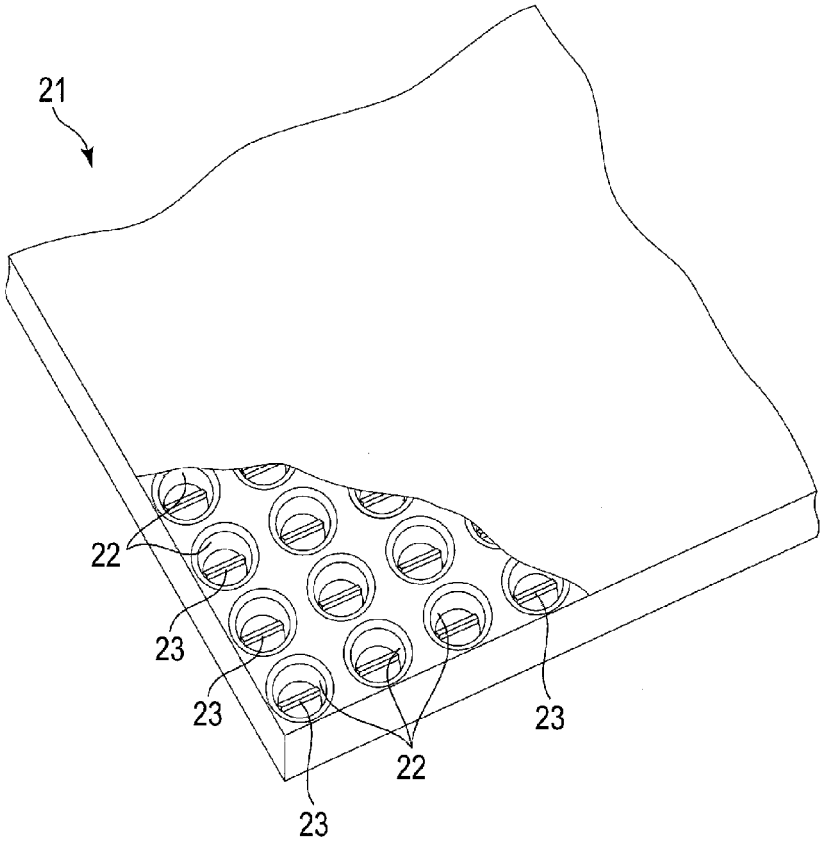
FIG. 2 is a partially cutaway perspective view showing a second tray used to add a flavor in the embodiment.
Figure 3:
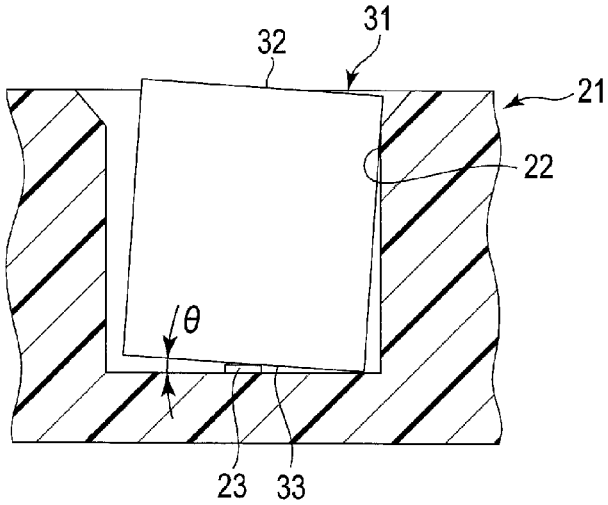
FIG. 3 is a cross sectional view showing a state in which a molded body of the final product length is stored in the second tray shown in FIG. 2.

The flavor adding step will be described in detail with reference to FIGS. 2 and 3, for example. As shown in FIGS. 2 and 3, a second tray 21 is prepared. The second tray 21 comprises a plurality of bottomed cylinder portions 22 opened at two-dimensionally regular intervals. An elongated projection 23 having a width sufficiently less than that of the bottomed cylindrical portion 22 is formed in the bottom of each cylindrical portion 22, for example, across the bottom surface thereof.

A molded body 31 of the final product length is inserted to each of the bottomed cylindrical portions 22 of the second tray 21 with end surfaces 32 and 33 of each molded body 31 being positioned upward and downward in such a manner that a part of the lower surface of each molded body 31 is brought into contact with the respective projection 23. Thus, each molded body is stored in the respective bottomed cylindrical portion 22 so as to be inclined at an angle of 0 with respect to the bottom of the bottomed cylindrical portion 22. In other words, each molded body 31 is stored in the respective bottomed cylindrical portion 22 in such a state that the ventilation passages are inclined with relative to the direction of gravity. Thereafter, a predetermined amount of a liquid flavor is sprayed from an injection nozzle (not shown) onto the end surface 32 (the upper surface) of the molded body 31 in each bottomed cylindrical portion 22. At this time, when the molded body 31 has a honeycomb structure, which will be described later, the sprayed liquid flavor descends towards the bottom thereof through a plurality of ventilation passages of the honeycomb structure. By setting the molded bodies 31 inclined at an angle of θ, the sprayed liquid flavor moves downward while slowly migrating in inner surfaces of the ventilation passages and in an outer wall of the honeycomb structure. As a result, the liquid flavor can be impregnated throughout the honeycomb structure. Thus, a tobacco molded article in which the flavor is added to the molded body of the final product length entirely, can be produced.

Note that, in the flavor adding step, it suffices if the molded bodies of the final product length are held in such a manner that the ventilation passages are inclined with respect to the direction of gravity as described above. Therefore, instead of providing the projection on the bottom surface of each of the bottomed cylindrical portions in the second tray, for example, the bottom surface itself of each bottomed cylindrical portion may be inclined, or a projection may be provided on an inner surface of each bottomed cylindrical portion, so as to incline the molded bodies of the final product length with respect to the direction of gravity when inserted to the bottomed cylindrical portions.

Further, for example, only a part of the bottom surface of each molded body is brought into contact with the projection or the like, and thus the contact area between the lower end surface of the molded body and the bottom surface of the bottomed cylindrical portion can be reduced. Therefore, it is possible to prevent each molded body from attaching to the bottom surface of the bottomed cylindrical portion after the molded article absorbing the flavor.

Moreover, in the case where the projection is formed to be cylindrical in place of the elongated shape and the molded body is formed to have a honeycomb structure comprising a plurality of ventilation passages, the cylindrical projection should only be formed greater than the diameter of the ventilation passages. Further, the projections may be semi-cylindrical or polygonal column such as a quadratic prism.

Furthermore, when a flavor is added, the molded bodies are not limited to those of the final product length obtained in the secondary cutting step after drying, but may be those cut into the final product length before drying.

The tobacco molded articles are packed in packages in a packaging step S11 immediately after the production.

If the inclination angle θ of the molded bodies is excessively large while spraying the liquid flavor, the liquid flavor may not be propagated to some places in the ventilation passages and the outer circumferential wall of each molded body, thereby making it difficult to impregnate the liquid flavor to the entire honeycomb structure. On the other hand, if the inclination angle θ of the molded bodies is excessively small, that is, in a state close to the direction of gravity, most of the sprayed liquid flavor drops directly downward without being propagated to the inner surfaces of the ventilation passages of the honeycomb structure or the outer circumferential wall thereof. Thus, it is difficult to impregnate the liquid flavor throughout the honeycomb structure. Therefore, the inclination angle θ of the molded bodies of the final product length while spraying the liquid flavor should preferably be 1° or greater and 10° or less, and more preferably 4° or greater and 8° or less. Nowadays, unlike the conventional cigarettes, it is difficult to differentiate the brands of cigarette molded articles by the function or the appearance of the wrapping paper or the filter, etc., and therefore the differentiation in taste by flavor becomes important.

Liquid flavors to differentiate the brand of tobacco molded article are referred to as a second flavor components as compared to the flavor components originated from the tobacco raw material (first flavor). In the embodiment, the tobacco mixture described above contains the first flavor originated from the tobacco raw material. However, the second flavor does not substantially be contained in the tobacco mixture.

Figure 4:
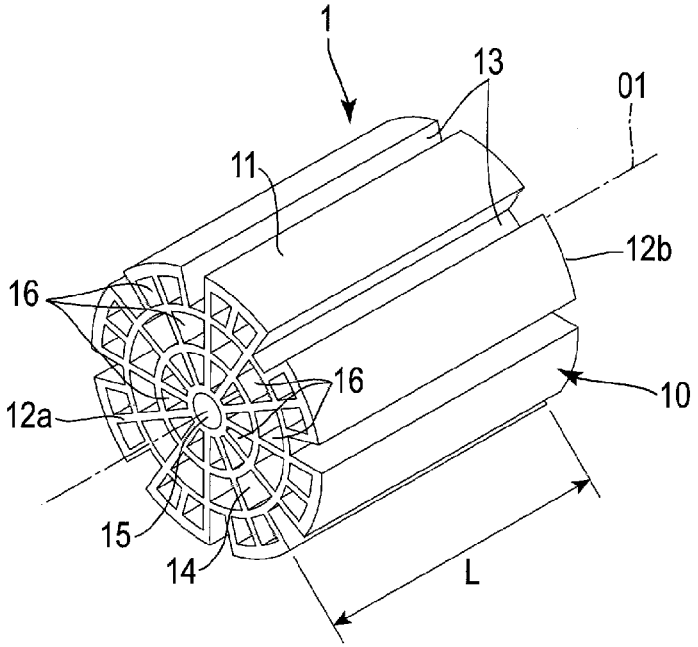
FIG. 4 is a perspective view of a tobacco molded article produced by the method according to the embodiment.
Figure 5:
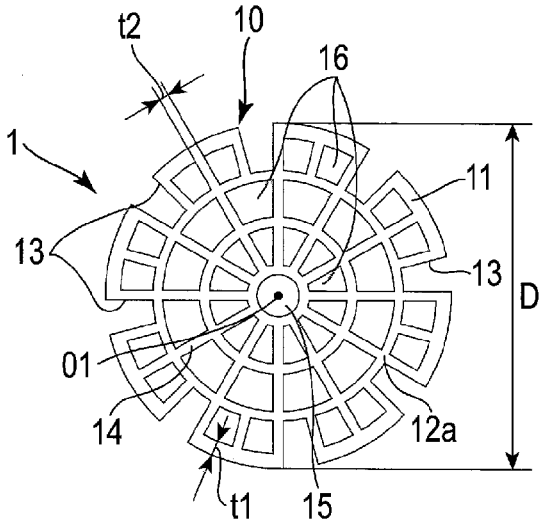
FIG. 5 is a front view of the tobacco molded article produced by the method according to the embodiment.

The liquid flavor is usually prepared by dissolving a second flavor into a solvent. Examples of the second liquid flavor include those generally used such as menthol and the like. The second liquid flavor may be a single flavor of those or a blended flavor prepared by blending a plurality of kinds of flavors. Examples of the solvent include ethanol and water. The liquid flavor used here is prepared by dissolving or diluting the second flavor with a solvent. The tobacco molded article thus obtained should preferably have a honeycomb structure shown in FIGS. 4 and 5.

A tobacco molded article 1 according to the embodiment is formed into a cylindrical shape having a a central axis 01. The tobacco molded article 1 has a honeycomb structure 10. The honeycomb structure 10 comprises an outer circumferential wall 11, a first end surface 12*a* and a second end surface 12*b*. The outer circumferential wall 11 coaxially surrounds the center axis 01 of the tobacco molded article 1. The first end surface 12*a* is positioned at one end along the axial direction of the outer circumferential wall 11. The second end surface 12*b* is positioned at the other end along the axial direction of the outer circumferential wall 11. The first end surface 12*a* and the second end surface 12*b* extend along a direction perpendicular to the center axis 01.

A plurality of grooves 13 are formed in the outer circumferential wall 11 along the central axis 01. The grooves 13 are arranged at intervals along a circumferential direction of the outer circumferential wall 11. The grooves 13 are opened on the first end surface 12*a* and the second end surface 12*b*.

The honeycomb structure 10 comprises lattice-shaped partition walls 14 and a central hole 15 in a region surrounded by the outer circumferential wall 11. The partition walls 14 define a plurality of ventilation passages 16 within the honeycomb structure 10. The ventilation passages 16 extend along the axial direction of the center axis 01 and are partitioned from each other by the partition walls 14. Moreover, the ventilation passages 16 are opened in the first end surface 12*a* and the second end surface 12*b* of the honeycomb structure 10. The shape of the lattice is not particularly limited, but various shapes can be applied, such as a square lattice, hexagonal lattice and triangular lattice.

The center hole 15 is formed coaxially with the central axis 01 of the honeycomb structure 10. The center hole 15 is surrounded by the ventilation passages 16 and also opened in the first end surface 12*a* and the second end surface 12*b* of the honeycomb structure 10.

According to the embodiment, an overall length L of the tobacco molded article 1 along the central axis 01 should preferably be, for example, 1 to 40 mm, and a diameter D of the tobacco molded article 1 should preferably be, for example, 5 to 15 mm. Further, a thickness t1 of the circumferential wall 11 of the honeycomb structure 10 should preferably be in a range of 0.1 to 0.5 mm. Similarly, a thickness t2 of the partition walls 14 of the honeycomb structure 10 should preferably be in a range of 0.1 to 0.5 mm.

In a cross section perpendicular to the central axis 01 of the honeycomb structure 10, the ratio of the opened area to the total cross-sectional area (aperture ratio) should preferably be in a range of 30 to 55%.

The opened area include those of the grooves 13, the center hole 15 and the ventilation passages 16.

The aperture ratio can be calculated based on the following equation:

$$\text{Aperture ratio [\%]}=\{(\text{total cross-sectional area} - \text{the cross-sectional area of the outer wall and the partition walls})/\text{total cross-sectional area}\}\times 100$$

Figure 6:
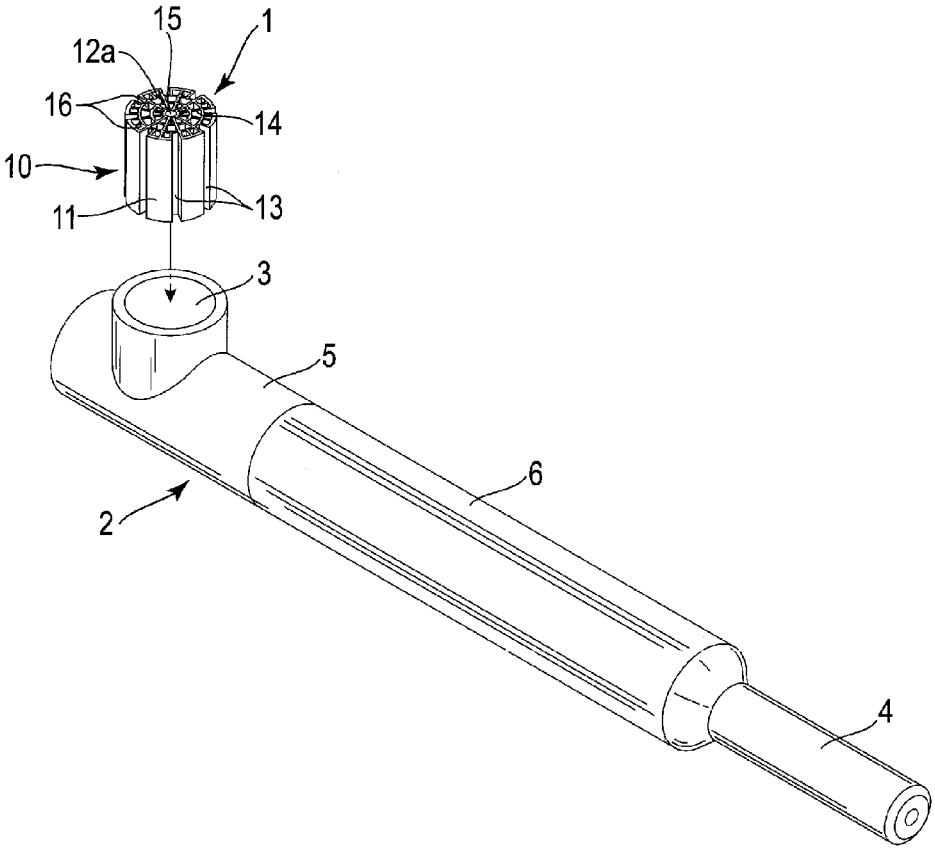
FIG. 6 is a perspective view showing a state in which the tobacco molded article produced by the method according to the embodiment is set in a pipe-shaped smoking article.

The tobacco molded article according to the embodiment can be subjected to smoking using a pipe-shaped smoking tool shown in FIG. 6, for example.

FIG. 6 is a perspective view showing a pipe-shaped smoking tool 2 in which a cylindrical tobacco molded article 1 is set. The smoking tool 2 comprises, as main structural elements, a fire bowl 3 in which a tobacco molding article 1 is to be inserted, a mouthpiece 4 to be put in the mouth of the smoker, and a metallic pipe portion 5 which connects the fire bowl 3 and the mouthpiece 4. A section of the pipe portion 5 to be gripped by the smoker with the hand is covered with a cover 6 of, for example, silicone. The tobacco molded article 1 inserted to the fire bowl 3 smolders by lit. When the tobacco molded article 1 is smoldering, the flavor component of the tobacco raw material (first flavor) and the added flavor (second flavor) are released. The released flavors are supplied to the smoker from the pipe section 5 through the mouthpiece 4.

According to the embodiment described above, a flavor to differentiate the brand is added to the dried molded body containing a tobacco raw material, a binder and water, and therefore the following advantages can be obtained.

1) As in the conventional techniques, in the case where the flavor (second flavor) is added to tobacco kneaded materials used in extrusion molding and the tobacco molded articles are differentiated into various brands by the second flavors added thereto, the tobacco mixture needs to be changed from its formulation each time the brand is changed. Therefore, the switching of a brand affects substantially all the steps of the production. Moreover, especially close attention is required to the lingering scent, and in the steps affected by the switching of the brand, not only cleaning work needs to be naturally carried carefully when switching, but also the use of a resin material which easily absorb scent must be limited, or the material needs to be replaced each time the brand is changed.

In this embodiment, the flavor to differentiate the brand is added to the molded body after drying, the producing steps up to the flavor adding step can be shared in common regardless of the brands of the tobacco molded articles, and therefore the switching of brands can be simplified. In particular, when the addition of flavor to a molded body is carried out immediately before the packaging step, only the flavor adding step and the packaging step need to be changed for switching the brand, thereby the workload can be reduced.

Further, since it is not necessity to consider the lingering scent, no careful flavor removal operation is required for various equipment including the kneading, extrusion molding, cutting, and drying equipments at the time of switching. As a result, it is possible to eliminate an additional effort in producing the tobacco molded articles, and therefore the productivity can be improved.

2) When the flavor (second flavor) is added to the tobacco kneaded materials used in extrusion molding, some flavors, depending on their components, volatilize mostly in the drying step after the extrusion molding, thereby making it difficult to differentiate the brands by the difference in flavor.

According to the embodiment, the flavor to differentiate the brand (second flavor) is added to the molded body after drying, and therefore tobacco molded articles of different brands each containing a specific amount of flavor, with differentiated flavors can be easily produced regardless of the properties of the flavor components (for example, easily volatile properties).

Further, in the embodiment, the object to which the flavor is added is one physically continuous molded body rather than a plurality of solid members as in the case of cut tobacco of cigarettes. Therefore, even if a flavor is locally added to the molded body, the flavor is diffused in the molded body over time (for example, during distribution). Such an effect can not be expected in the case where the object to which a flavor is added includes a plurality of solid members as in the case of cut tobacco of cigarettes.

Further, by adding a polyol such as propylene glycol to the tobacco mixture, the molded body can be made porous as the polyol vaporizes from the molded body during drying. As a result, the permeability to the molded body of the flavor added after drying can be promoted.

Further, the flavor-adding step includes a step of setting the conditioned molded body of the final product length comprising ventilation passages formed along at least the axial direction, in such a manner that the ventilation passages are inclined with respect to the gravity direction, and a step of adding a flavor to the upper surfaces while the ventilation passages of the molded body being inclining, thereby making it possible to added the flavor to the molded body to be uniformly diffused therein.

In the flavor adding step, it is preferable as shown in FIGS. 2 and 3 described above that a molded body 31 is inserted to each of the bottomed cylindrical portions 22 of the second tray 21 with end surfaces 32 and 33 of each molded body 31 being positioned upward and downward in such a manner that a part of the lower surface of each molded body 31 is brought into contact with the respective elongated projection 23, and thus each molded body of the final product length is stored in the respective bottomed cylindrical portion 22 so as to be inclined at an angle of θ with respect to the bottom of the bottomed cylindrical portion 22. In other words, each molded body 31 of the final product length is stored in the respective bottomed cylindrical portion 22 in such a state that the ventilation passages are inclined with relative to the direction of gravity. In this case, when the molded body 31 has a honeycomb structure described above, the sprayed liquid flavor moves downward while slowly migrating in inner surfaces of the ventilation passages and in an outer wall of the honeycomb structure. As a result, the liquid flavor can be impregnated throughout the honeycomb structure. Thus, the flavor can be quickly and evenly spread over the molded body. Therefore, it is possible to obtain a tobacco molded article in which the flavor is added all over the molded body even if the flavor is added just before the packaging of the molded articles.

3) When the flavor (second flavor) is added to a tobacco kneaded material used in extrusion molding, the flavor is not uniformly mixed, the flavor is unevenly distributed in the molded body immediately after the extrusion molding. As a result, when the molded body is cut in the second cutting step into pieces of the final product length, the amount of the flavor varies from one molded body of the final product length to another.

In embodiments, a predetermined amount of flavor (second flavor) is added to a plurality of molded bodies of the final product length after drying in units of each molded body, the variation in the amount of flavor between the molded bodies can be avoided, thereby obtaining a high-quality tobacco molded article.

According to the embodiment described above, further advantageous effects listed below can be achieved.

a) When continuously molding to obtain the molded body by an extrusion molding machine and drying the molded body continuously as it is, large-scale drying equipment is required.

According to the embodiment, a rod-shaped molded body extruded from the extrusion machine is cut in the primary cutting step into pieces of a predetermined length, that is, a length suitable for the drying equipment, and therefore the drying equipment can be downsized (reduced in size).

b) The problem a) can be solved if the molded body is cut to the final product length immediately after the extrusion molding. However, for example, when the molded body has a honeycomb structure as described above, the molded body has high moisture content and therefore is easily deformable immediately after the extrusion. For this reason, it is difficult to cut the body while maintaining the quality of the cut surface.

According to the embodiment, in the secondary cutting step, the molded body after drying having low moisture content and being hardened is cut to the final product length, and therefore, for example, even if the molded body has a honeycomb structure, the deformation of the honeycomb structure, or the occurrence of clogging caused by cut chips can be avoided, and therefore a molded body of the final product length can be obtained while maintaining the quality of the cut surface.

c) The problem b) can be solved by quickly drying the rod-shaped molded body immediately after extrusion molding as disclosed in JA 3084387 B.

However, in the case where the rod-shaped molded body has a honeycomb structure, quick drying carried out immediately after the extrusion molding may easily cause warping or cracking of the molded body due to uneven drying rate within the rod-shaped molded body.

According to the embodiment, a batch method is adopted, the molded body is cut in the primary cutting step into pieces of a length suitable for the drying equipment, the cut molded bodies of the length suitable for the drying equipment are laid in a plurality of grooves of the first tray to be aligned in the aligning step, and the first tray is loaded into the drying equipment in the drying step. Thus, the molded body to be dried can be made shorter than the rod-shaped molded body, and therefore slow drying can be carried out.

Therefore, it is possible to prevent even a molded body having a honeycomb structure from warping and cracking to a minimum level.

Further, when a polyol such as propylene glycol is added to the tobacco mixture, a longer drying time is required to removal the polyol, and therefore, in the case of a continuous process, the equipment tend to become large in scale. According to the embodiment, the primary cutting step of cutting the continuous molded body and the batch method are both adopted, thereby making it possible to suppress the increase in scale of the equipment.

Further, when the molded body to be dried is formed shorter than the rod-like molded body and a polyol such as propylene glycol is applied to the molded body, the polyol in the molded body volatilizes while drying not only from the outer circumferential surface thereof but also the end surfaces created in the primary cutting, thereby making it possible to further promote the porosity of the molded body.

Hereinafter, an example will be described in detail.

EXAMPLE 1

A tobacco mixture containing 44.0% by weight of a tobacco raw material, 12.9% by weight of propylene glycol, 1.4% by weight of glycol, 7.1% by weight of calcium carbonate, 3.4% by weight of carboxymethyl cellulose and 31.1% by weight water was kneaded by a kneader to prepare a kneaded material. The kneaded material was then continuously extruded using an extruder. The molded body thus obtained had a honeycomb structure shown in FIGS. 3 and 4 described above, and the diameter along the transverse direction was 7.2 mm. Subsequently, the rod-shaped molded body was cut in the primary cutting step into pieces of a length suitable for the drying equipment.

The primarily cut molded bodies were aligned on a tray exclusively used for drying, which was then loaded into the drying equipment. The molded bodies were dried to a moisture content of 3% by weight in the drying equipment.

The molded bodies after drying were then subjected to the secondary cutting step under such blade conditions of an outermost speed of 120 m/sec and a feeding rate of 14.4 mm/sec to obtain molded bodies of the final product length (14.4 mm). The molded bodies were conditioned until they had a moisture content of, about, 10% by weight.

Then, a plurality of conditioned molded bodies 31 were inserted respectively to the bottomed cylindrical portions 22 of the second tray 21 shown in FIGS. 2 and 3 described above, with the end surfaces 32 and 33 being positioned upward and downward, and the molded bodies 31 were stored to be inclined by the projections 23 at an angle of 4° with respect to the bottom surfaces of the bottomed cylindrical portions 22. Subsequently, while moving the injection nozzle directly above the molded bodies 31 in the bottomed cylindrical portions 22, the liquid flavor is sprayed through the injection nozzle onto each the molded body 31 to add flavor thereto. The liquid flavor was prepared by diluting menthol with ethanol and water. Furthermore, the liquid flavor was added thereto in an amount commensurate with the brand of the tobacco molded article. Then, the tobacco molded articles unloaded from the second tray were immediately packaged without conditioning.

The tobacco molded articles thus obtained maintained the amount of the liquid flavor added at the time of the injection.

Further, a tobacco molded article 1 thus obtained was inserted to the fire bowl 3 of the pipe-shaped smoking tool 2 shown in FIG. 6, and then the tobacco molded article 1 is lit while suctioning through the mouthpiece 4 to be smoldered. It was confirmed that the ignition property is the entire surface ignition and the sustainability of smoldering was sustained perfectly. During smoldering, the flavor components of the tobacco raw material (first flavor) and the added flavor (second flavor) were released, and the released flavors were supplied to the smoker through the mouthpiece 4 from the pipe section 5.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of producing a tobacco molded article, comprising:

formulating a tobacco kneaded material by kneading a tobacco mixture containing a tobacco raw material, a binder and water;

molding the tobacco kneaded material to obtain a molded body;

adding a flavor to the molded body, and further comprising secondarily cutting the cut molded bodies into a final product length before the adding the flavor, wherein each of the molded bodies of the final product length comprises ventilation passages at least along an axial direction, and the adding the flavor comprises inclining the ventilation passages of the molded bodies of the final product length with respect to a direction of gravity, and adding a flavor to upper surfaces of the molded bodies while the ventilation passages of the molded bodies being inclined.

2. The method of claim 1, wherein the molding comprises extrusion molding capable of obtaining a continuous molded body.

3. The method of claim 2, wherein the molding further comprises primarily cutting the continuous molded body to obtain cut molded bodies, and drying the cut molded bodies.

4. The method of claim 3, wherein the continuous molded body comprises ventilation passages at least along an axial direction, and the primarily cutting comprises cutting with a wire vibrated.

5. The method of claim 3, wherein the drying comprises preparing a first tray having a plurality of grooves, horizontally arranging the cut molded bodies in the grooves of the first tray, respectively, and loading the first tray into a drying equipment to dry the cut molded bodies arranged in the first tray.

6. The method of claim 3, wherein the secondarily cutting is conducted after the drying and before the adding the flavor.

7. The method of claim 1, wherein the adding the flavor comprises:

preparing a second tray comprising a plurality of bottomed cylindrical portions and projections each provided in a bottom of each bottomed cylindrical portion and having a width less than that of the cylindrical portions;

inserting the molded bodies of the final product length to the bottomed cylindrical portions of the second tray, respectively, such that cut surfaces thereof are positioned upward and downward, and a part of a lower cut surface of each molded body being in contact with the respective projection to store the molded bodies in the bottomed cylindrical portions while the ventilation passages thereof are inclined with respect to the direction of gravity; and spraying a flavor on an upper surface of each of molded bodies stored in each of the bottomed cylinder portions.

8. The method of claim 1, wherein the tobacco mixture further comprises polyol.

9. The method of claim 8, wherein the polyol is propylene glycol.

10. The method of claim 1, wherein the adding the flavor is carried out immediately before packaging.

* * * * *